US007308758B2

(12) United States Patent
Sausner et al.

(10) Patent No.: US 7,308,758 B2
(45) Date of Patent: Dec. 18, 2007

(54) METHOD FOR MAKING SHEATHED METAL TUBE

(75) Inventors: Andreas Sausner, Frankfurt (DE); Georg Weick, Plankstadt (DE); Delbert L. Adkins, Clinton Township, MI (US); David Poirier, Fort Gratiot, MI (US)

(73) Assignee: TI Automotive (Heidelberg) GmbH, Heidelberg (DE)

( * ) Notice: Subject to any disclaimer, the term of this patent is extended or adjusted under 35 U.S.C. 154(b) by 17 days.

(21) Appl. No.: 10/796,934

(22) Filed: Mar. 9, 2004

(65) Prior Publication Data

US 2004/0194298 A1 Oct. 7, 2004

(30) Foreign Application Priority Data

Mar. 25, 2003 (DE) ..... 103 13 242

(51) Int. Cl.
*H01R 43/00* (2006.01)

(52) U.S. Cl. ..... 29/825

(58) Field of Classification Search ..... 29/508, 29/505, 506, 460, 428, 825; 156/304.2
See application file for complete search history.

(56) References Cited

U.S. PATENT DOCUMENTS 5,940,952 A * 8/1999 Ikeda et al. ..... 29/423
6,988,311 B2 * 1/2006 Otto et al. ..... 29/825

FOREIGN PATENT DOCUMENTS

FR 2817953 * 6/2002

* cited by examiner

*Primary Examiner*—John C. Hong
(74) *Attorney, Agent, or Firm*—Leydig, Voit & Mayer, Ltd.

(57) ABSTRACT

In a method for grounding a metal tube (2) sheathed with an electrically non-conducting plastic layer (1), has the plastic layer (1) of the metal tube (2) completely removed at an area of connection (3) the area of connection (3) is connected to the motor vehicle part in an electrically conducting fashion by a conductive covering section (4) is closed in the circumferential direction of the metal tube (2) which covers the area of connection (3) on all sides or more than covers the area of connection (3) on all sides, i.e. in the form of a crimp sleeve or a heat-shrinkable sleeve. It is first pushed onto the metal tube (2) and is then pressed onto the metal tube (2) at least at its ends under radial pressure applied along at least part of the circumference without any gaps. In one form, the tube has a bead in the area where the plastic layer is removed and the bead is in contact with the conductive covering section.

21 Claims, 2 Drawing Sheets

METHOD FOR MAKING SHEATHED METAL TUBE

BACKGROUND OF THE INVENTION

This invention relates to a method for earthing (grounding) a metal tube sheathed with an electrically non-conducting plastic layer, which is used in a motor vehicle for transporting liquid or gaseous media, especially fuels, on a metal motor vehicle part, especially the chassis of the motor vehicle, wherein the plastic layer of the metal tube is completely removed at an area of connection and said area of connection is then connected to the motor vehicle part in an electrically conducting fashion.

Within the scope of the invention, the metal tube is preferable made of single-layer welded or multi-layer soldered steel tube which is provided on the outside with a base-metal layer (e.g. AI, Zn or Galfan) as an anti-corrosion layer.

In a method of said type known from practice which is not confirmed in detail in publications, the area of connection is connected directly to the motor vehicle part in an electrically conducting fashion. As a result of the plastic layer being partly missing in the area of the joint, the corrosion and abrasion resistance of the metal tube unfortunately deteriorates.

The object of the invention is to provide a perfect electrical join between metal tube and the other motor vehicle part such as chassis within the framework of the measures specified initially without impairing the corrosion and abrasion resistance.

For this purpose the present invention teaches that a covering section which covers the area of connection on all sides or preferably more than covers said area of connection is first pushed onto the metal tube and is then pressed onto the metal tube at least at its ends under radial pressure applied along at least part of the circumference without any gaps, and the covering section is then connected to the motor vehicle part in an electrically conducting fashion. The covering section can be pressed onto the metal tube without any gaps at least at its ends under radial pressure applied along the total circumference.

The invention in this case starts from the reasoning that the problem of inadequate corrosion and abrasion resistance of the metal tube can be eliminated by the fact that sealing of the exposed metal surface can be provided by an additional covering section so that the product is protected against external environmental influences such as contact with spray water, and the corrosion effects associated therewith.

The metal tube especially comprises a steel tube. As has already been described initially, an electrically conductive anti-corrosion layer, which consists of a base metal, for example, of zinc or aluminum, is suitably located on the metal tube. It is within the scope of the invention that the anti-corrosion layer is arranged between the metal tube and the plastic layer.

The plastic layer is removed at a certain point on the tube at a certain width. In this case, according to one embodiment, the plastic layer can be removed mechanically, for example, it can be peeled off. According to another embodiment of the invention, the plastic layer can however also be removed with the aid of laser treatment. The plastic layer can be removed either over the total circumference of the tube (360°) or over a partial area of the circumference (for example, 90°). The depth to which the plastic layer is removed in the radial direction of the tube either extends as far as the surface of the metal tube or as far as the electrically conductive anti-corrosion layer.

Within the scope of the invention there are a plurality of possibilities for the shaping of the electrically conductive covering section. According to one embodiment, the covering section is constructed as closed in the circumferential direction of the metal tube. According to a first preferred embodiment, the covering section consists of a metal crimp sleeve, especially of aluminum or stainless steel. It is recommended that this crimp sleeve is pressed on mechanically.

In a second, very preferred embodiment, the covering section consists of a heat-shrinkable sleeve made of an electrically conductive plastic or a plastic made conductive by additives. This heat-shrinkable sleeve is advantageously shrunk onto the metal tube by heat treatment. In this case, according to one embodiment, this heat-shrinkable sleeve is also provided on the inside with an electrically conductive adhesive coating.

According to a particular embodiment of the invention, a bead or upset, which runs around the circumference of the tube is first produced on the tube. The bead projects radially from the surface of the tube. It is especially within the scope of the invention to produce such a bead at one section of the tube. At least the plastic layer covering the bead is suitably removed and preferably over the total circumference of the bead. This exposed metal surface of the bead then forms the area of connection of the metal tube. The area of connection at such a bead has the advantage that the exposed metal surface is larger than a corresponding area of connection of the same width in another region of the tube. According to the invention, a heat-shrinkable sleeve made of electrically conductive plastic is applied/pushed onto the metal tube or onto the bead. This heat-shrinkable sleeve is then shrunk onto the metal tube or onto the bead by heat treatment. In this case, the heat-shrinkable sleeve can be provided on the inside with an electrically conductive adhesive coating.

The subject matter of the invention is also a sheathed metal tube according to the claims 10.

DETAILED DESCRIPTION OF THE DRAWINGS

In order to earth (ground) a metal tube 2 sheathed with an electrically non-conducting plastic layer 1, which is used in a motor vehicle for transporting liquid or gaseous media, especially fuels, on a metal motor vehicle, especially the chassis of the motor vehicle, the plastic layer 1 of the metal tube 2 is completely removed at an area of connection 3 over the total circumference. A cylindrical covering section 4 which is closed in the circumferential direction of the metal tube 2 and which more than covers the area of connection 3 on all sides is pushed onto the metal tube 2 and is then pressed onto the metal tube 2 at least at its ends under radial pressure applied along at least part of the circumference without any gaps. The covering section is then connected to the motor vehicle part in an electrically conducting fashion which is not shown in detail. The covering section is illustrated as being of a cylindrical shape. However, numerous polygonal shapes which are generally annular but have a plurality of flat sidewalls are envisioned within the shape of the invention.

Figure 1:
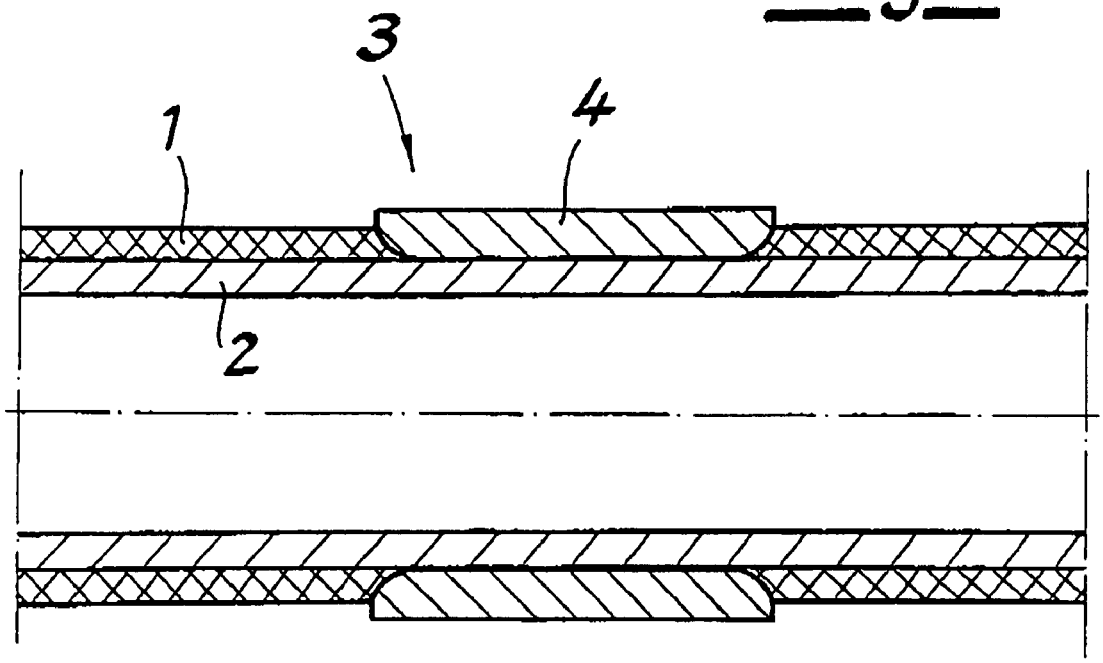
FIG. 1 shows a cross-section through an electrically conducting joint of a metal tube with a motor vehicle part.

In the embodiment according to FIG. 1, the covering section 4 consists of a metal crimp sleeve made of aluminum or stainless steel. This crimp sleeve 4 is pressed on mechanically so that the crimp sleeve 4 has contact over its total length and thus also in the exposed part 3 of the metal tube 2.

Figure 2:
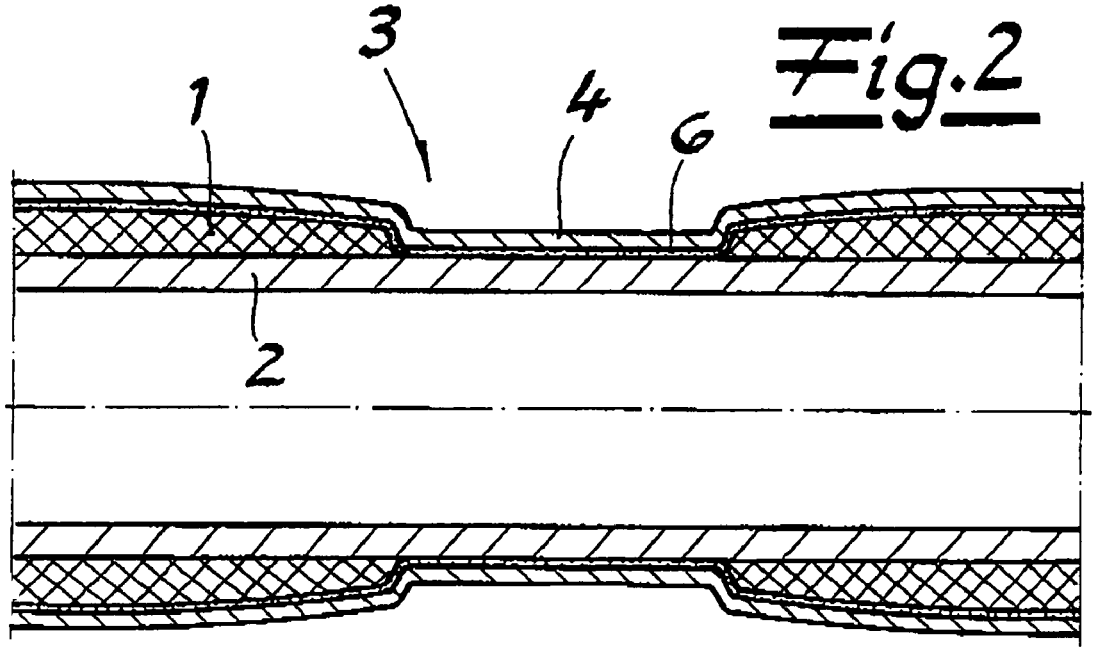
FIG. 2 shows a second embodiment of such a joint.

In the embodiment according to FIG. 2, the covering section 4 consists of a heat-shrinkable sleeve made of electrically conductive plastic or plastic made conductive by additives as is known. This heat-shrinkable sleeve 4 has been heat shrunk onto the metal tube 2 by heat treatment, wherein the heat-shrinkable sleeve 4 can have been initially provided with an electrically conductive inner layer on its inside. In this embodiment and in the embodiment shown in FIG. 3 which is explained subsequently, the pressing on of the covering section is accomplished under radial pressure by shrinking on.

Figure 3:
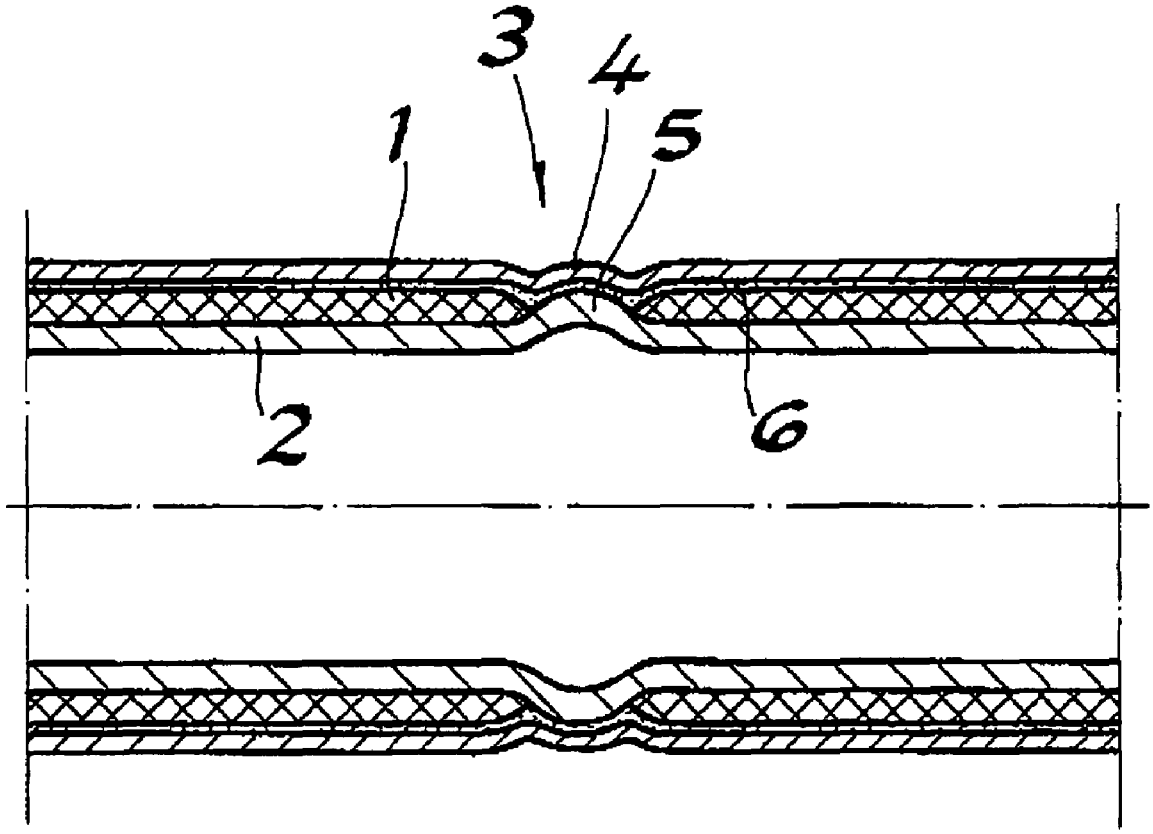
FIG. 3 shows a third embodiment of the subject matter from FIG. 1.

In the embodiment according to FIG. 3 the covering section 4 consists of a heat-shrinkable sleeve made of electrically conductive plastic. In this embodiment a radially outwardly extending bead or upset 5 which runs around the circumference of the tube was first produced on the tube. The plastic layer 1 covering the bead 5 was removed and in this way the area of connection 3 was obtained on the bead 5. The heat-shrinkable sleeve 4 has been shrunk onto the metal tube 2 or onto the bead 5 by heat treatment. In this embodiment the heat shrinkable sleeve 4 is also provided with an electrically conductive adhesive coating 6 on the inside.

While in the foregoing embodiments of the invention have been disclosed in considerable detail for the purposes of illustration, it will be understood by those skilled in the art that many of these details may be varied without departing from the spirit and scope of the invention.

The invention claimed is:

1. A method for making a metal tube (2) sheathed with an electrically non-conducting plastic layer (1), for use in a motor vehicle for transporting liquid or gaseous media, especially fuels, and which is adapted to be connected to a conductive portion of the motor vehicle, the steps comprising, completely removing said plastic layer (1) over the total circumference of the metal tube (2) at an area of connection (3), providing a conductive covering section (4) and at least covering the area of connection (3) on all sides of the area of connection (3) with said conductive covering section (4) and pressing said conductive covering onto the metal tube (2) at least at its ends under radial pressure applied along at least part of the circumference without any gaps.

2. The method according to claim 1, characterized in that the plastic layer is removed at a certain point on the tube at a certain width, and the covering section (4) is constructed as closed in the circumferential direction of the metal tube (2) and the conductive covering section overlies a portion of said plastic layer adjacent both longitudinal ends of said area of connection.

3. The method according to any one of claims 1 or 2, characterized in that the covering section (4) consists of a metal crimp sleeve.

4. The method according to claim 3, characterized in that the crimp sleeve (4) consists of aluminum or stainless steel.

5. The method according to any one of claims 2 or 4, characterized in that the crimp sleeve (4) is pressed on mechanically.

6. The method according to any one of claims 1 or 2, characterized in that the covering section (4) consists of a heat-shrinkable sleeve made of electrically conductive plastic.

7. The method according to claim 6, characterized in that the heat-shrinkable sleeve (4) is shrunk onto the metal tube (2) by heat treatment.

8. The method according to claim 7, characterized in that the heat-shrinkable sleeve (4) is provided with an electrically conductive adhesive coating on the inside.

9. The method according to claim 6, characterized in that the heat-shrinkable sleeve (4) is provided with an electrically conductive adhesive coating on the inside.

10. A method for making a metal tube (2) sheathed with an electrically non-conducting plastic layer (1), for use in a motor vehicle for transporting liquid or gaseous media, especially fuels, and which is adapted to be connected to a conductive portion of the motor vehicle, the steps comprising, completely removing said plastic layer (1) over at least a partial area of the circumference of the metal tube (2) at an area of connection (3), providing a conductive covering section (4) which covers the area of connection (3) on all sides or more than covers the area of connection (3) on all sides, the covering section (4) consists of a heat-shrinkable sleeve made of electrically conductive plastic, pressing said conductive covering onto the metal tube (2) at least at its ends under radial pressure applied along at least part of the circumference without any gaps, wherein at least one bead (5) which runs around the circumference of the metal tube (2) is produced on said metal tube (2) and wherein the plastic layer (1) covering the bead (5) is removed at least over part of the bead circumference, preferably over the total bead circumference, and wherein the heat-shrinkable sleeve made of electrically conductive plastic is pushed onto the area of connection (3) on the bead (5).

11. The method according to claim 10, characterized in that the heat-shrinkable sleeve (4) is shrunk onto the metal tube (2) by heat treatment.

12. The method according to claim 10, characterized in that the heat-shrinkable sleeve (4) is provided with an electrically conductive adhesive coating on the inside.

13. The method according to claim 11, characterized in that the heat-shrinkable sleeve (4) is provided with an electrically conductive adhesive coating on the inside.

14. A method for making a metal tube (2) sheathed with an electrically non-conducting plastic layer (1), for use in a motor vehicle for transporting liquid or gaseous media, especially fuels, and which is adapted to be connected to a conductive portion of the motor vehicle, the steps comprising, completely removing said plastic layer (1) over at least a partial area of the circumference of the metal tube (2) at an area of connection (3), providing a conductive covering section (4) which covers the area of connection (3) on all sides or more than covers the area of connection (3) on all sides, the covering section (4) consists of a heat-shrinkable sleeve made of electrically conductive plastic, pressing said conductive covering onto the metal tube (2) at least at its ends under radial pressure applied along at least part of the circumference without any gaps, wherein at least one bead (5) which runs around the circumference of the metal tube (2) is produced on said metal tube (2), and wherein the plastic layer (1) covering the bead (5) is removed at least over part of the bead circumference, preferably over the total bead circumference, and wherein the heat-shrinkable sleeve made of electrically conductive plastic is pushed onto the area of connection (3) on the bead (5), and wherein the plastic layer is removed at a certain point on the tube at a certain width, and the covering section (4) is constructed as closed in the circumferential direction of the metal tube (2) and the conductive covering section overlies a portion of said plastic layer adjacent both longitudinal ends of said area of connection.

15. The meted according to claim 14, characterized in that the heat-shrinkable sleeve (4) is shrunk onto the metal tube (2) by heat treatment.

16. The method according to claim 15, characterized in that the heat-shrinkable sleeve (4) is provided with an electrically conductive adhesive coating on the inside.

17. The method according to claim 14, characterized in that the heat-shrinkable sleeve is provided with an electrically conductive adhesive coating on the inside.

18. A method for making a metal tube (2) sheathed with an electrically non-conducting plastic layer (1), for use in a motor vehicle for transporting liquid or gaseous media, especially fuels, and which is adapted to be connected to a conductive portion of the motor vehicle, the steps comprising, completely removing said plastic layer (1) over at least a partial area of the circumference of the metal tube (2) at an area of connection (3), providing a conductive covering section (4) of conductive plastic material which covers at least the area of connection (3) on all sides and pressing said conductive covering onto the area of connection of said metal tube (2) at least at its ends under radial pressure without any gaps.

19. The method according to claim 18, characterized in that the plastic layer is removed at a certain point on the rube at a certain width, and the covering section (4) overlies a portion of said plastic layer adjacent both longitudinal ends of said area of connection.

20. A method according to claims 1 or 18 wherein said tube includes an outer surface and said step of removal of said plastic layer from said tube (2) at said area of connection (3) exposes the outer surface of the tube.

21. A method according to claims 1 or 18 wherein said tube includes an outer surface, and an electrically conductive anti-corrosion layer (6) and said step of removal of said plastic layer (1) from said tube (2) at said area of connection (3) exposes said conductive anti-corrosion layer.

* * * * *